US011833506B2

(12) United States Patent
Decottignies et al.

(10) Patent No.: US 11,833,506 B2
(45) Date of Patent: Dec. 5, 2023

(54) FLUID PRODUCT DISPENSER

(71) Applicant: APTAR FRANCE SAS, Le Neubourg (FR)

(72) Inventors: Laurent Decottignies, Cergy (FR); Alain Lafosse, Franqueville Saint Pierre (FR); Jacky Bernard, Boos (FR)

(73) Assignee: APTAR FRANCE SAS, Le Neubourg (FR)

( * ) Notice: Subject to any disclaimer, the term of this patent is extended or adjusted under 35 U.S.C. 154(b) by 468 days.

(21) Appl. No.: 16/964,737

(22) PCT Filed: Jan. 25, 2019

(86) PCT No.: PCT/FR2019/050166

§ 371 (c)(1),
(2) Date: Jul. 24, 2020

(87) PCT Pub. No.: WO2019/145650

PCT Pub. Date: Aug. 1, 2019

(65) Prior Publication Data

US 2020/0346202 A1 Nov. 5, 2020

(30) Foreign Application Priority Data

Jan. 26, 2018 (FR) ..... 1850642

(51) Int. Cl.
*B01L 3/02* (2006.01)
*B05B 11/00* (2023.01)
(Continued)

(52) U.S. Cl.
CPC ..... *B01L 3/0241* (2013.01); *B01L 3/0282* (2013.01); *B05B 11/0035* (2013.01);
(Continued)

(58) Field of Classification Search
CPC ..... B01L 3/0241; B01L 3/0282; B01L 2300/042; B01L 2300/044;
(Continued)

(56) References Cited

U.S. PATENT DOCUMENTS 2,781,063 A 2/1957 Williams
3,379,196 A 4/1968 Mitchell
(Continued)

FOREIGN PATENT DOCUMENTS

FR 750 077 A 8/1933
FR 2 574 681 A1 6/1986
FR 2 978 431 A1 2/2013

OTHER PUBLICATIONS

International Search Report of PCT/FR2019/050166 dated Apr. 4, 2019 [PCT/ISA/210].
(Continued)

*Primary Examiner* — Matthew D Krcha
*Assistant Examiner* — Jacqueline Brazin
(74) *Attorney, Agent, or Firm* — Sughrue Mion, PLLC

(57) ABSTRACT

A fluid dispenser having a reservoir (R) containing fluid (P) and air (A), the reservoir (R) forming an assembly opening (11); a fluid dispenser cannula (12) in communication with the reservoir (R); and an actuator member (2) engaged in the assembly opening (11), for supplying the dispenser cannula (13) with fluid (P). The actuator member (2) has a deformable membrane (23) that defines an outside face (231) forming a pusher (24), and an inside face (232) that is in contact with the air (A) of the reservoir (R), when the dispenser cannula (12) is in contact with the fluid (P) of the reservoir (R).

9 Claims, 3 Drawing Sheets

(51) Int. Cl.
*B05B 11/04* (2006.01)
*B65D 83/00* (2006.01)

(52) U.S. Cl.
CPC ..... *B05B 11/048* (2013.01); *B65D 83/0094* (2013.01); *B01L 2300/042* (2013.01); *B01L 2300/044* (2013.01); *B01L 2300/0832* (2013.01); *B01L 2300/168* (2013.01); *B01L 2400/0481* (2013.01); *B01L 2400/0487* (2013.01); *B05B 11/0032* (2013.01)

(58) Field of Classification Search
CPC ..... B01L 2300/0832; B01L 2300/168; B01L 2400/0481; B01L 2400/0487; B05B 11/0035; B05B 11/048; B05B 11/0032; B05B 11/04; B05B 11/06; B65D 83/0094
USPC ..... 422/512
See application file for complete search history.

(56) References Cited

U.S. PATENT DOCUMENTS 4,973,450 A * 11/1990 Schluter ..... G01N 1/4077 436/63
2008/0314855 A1* 12/2008 Lee ..... G01N 35/1002 222/251

OTHER PUBLICATIONS

International Preliminary Report on Patentability with a Translation of Written Opinion in International Application No. PCT/FR2019/050166, dated Jul. 30, 2020.

* cited by examiner

FLUID PRODUCT DISPENSER

CROSS REFERENCE TO RELATED APPLICATIONS

This application is a National Stage of International Application No. PCT/FR2019/050166, filed Jan. 25, 2019, claiming priority to French Patent Application No. 1850642, filed Jan. 26, 2018.

The present invention relates to a fluid dispenser comprising a reservoir, a dispenser cannula, and an actuator member for supplying the dispenser cannula with fluid coming from the reservoir. The dispenser cannula may include a dispenser end that is suitable for forming a drop of fluid that separates from the cannula by gravity. The dispenser is thus like a dropper dispenser. In entirely general manner, this type of dispenser is used in the fields of perfumery, cosmetics, and pharmacy for dispensing fluids of various viscosities.

Conventional dropper dispensers comprise a cannula and an actuator member that makes it possible to suck fluid into the cannula and then drive it out from the cannula. To do this, it is necessary firstly to dip the end of the cannula into a fluid reservoir. Often, dropper dispensers are packaged in the assembled state, e.g. screw-fastened, on fluid reservoirs. Dropper dispensers alone do not allow fluid to be dispensed, but merely allow air to be sucked up and expelled. A dropper dispenser may be considered as being a simple squeezable bulb provided with a cannula.

In the prior art, document FR 2 978 431 is already known, which describes a fluid dispenser including a fluid reservoir, and a pump including a pump body and an actuator rod defining between them a pump chamber having a predetermined maximum volume. The rod is axially movable in the body so as to cause the volume of the pump chamber to vary. The dispenser further includes a dispenser cannula that is mounted on the actuator rod and that includes a dispenser end that is suitable for forming a drop of fluid that separates from the cannula by gravity. The maximum volume of the pump chamber is substantially equal to the volume of the drop of fluid that is dispensed at the dispenser head.

The present invention seeks to simplify that prior art fluid dispenser, and also others, particularly with regard to their structure and components, but without creating new problems, in particular while assembling the dispenser. More particularly, assembling the dispenser should not lead to accidental dispensing or to the fluid being put under pressure. Another object of the invention is to make a dropper device at lower cost, without compromising the quality and accuracy of dispensing. Another object is to design a dispenser with a small number of parts.

To achieve these objects, the present invention proposes a fluid dispenser, in particular of the dropper type, comprising:

- a fluid dispenser cannula in communication with the reservoir, the cannula forming a dispenser end that is advantageously suitable for forming a drop of fluid that separates from the dispenser end by gravity; and
- an actuator member engaged in the assembly opening, for supplying the dispenser cannula with fluid coming from the reservoir;

wherein the actuator member comprises a deformable membrane that defines an outside face forming a pusher, and an inside face that is in contact with the air of the reservoir, when the dispenser cannula is in contact with the fluid of the reservoir.

Thus, when pressure is applied on the pusher, e.g. by means of a finger or a thumb, the inside face of the membrane moves the air, which is put under pressure in the reservoir. The air under pressure acts on the fluid stored in the reservoir, and a portion (dose) of this fluid is then driven through the dispenser cannula. The fluid leaves the dispenser end of the cannula in the form of one or more individual drops that fall by gravity. When the user relaxes the pressure on the pusher, the membrane elastically returns to its start or rest position. Suction is thus established in the reservoir, thereby causing the cannula to be sucked empty (return into the reservoir), and causing the outside air to enter into the reservoir through the cannula. The reservoir ends up containing a little less fluid and a little more air.

The structure of the dispenser is very simple and its operation is intuitive and very accurate, since it is almost exclusively a matter of manual dexterity. The user immediately understands that it is necessary to keep the dispenser with its cannula pointing downwards so that the fluid is delivered directly to the dispenser cannula. It should also be observed that the pressure exerted by the membrane is applied to the air contained in the reservoir, which air is by nature compressible. As a result, pneumatic damping is created, such that the pressure exerted by the membrane is applied to the fluid with a certain amount of pneumatic damping, which avoids fluid being dispensed suddenly. This increases the accuracy of dispensing, which is easier for the user to control.

According to an advantageous characteristic of the invention, the actuator member includes an assembly sleeve that, during assembly, is inserted in sealed manner in the assembly opening of the reservoir. The assembly sleeve advantageously performs one sealed axial assembly stroke in the assembly opening of the reservoir in order to reach its final sealed assembled position, the sealed axial stroke defining a stroke volume Vc. In addition, the deformable membrane is movable between a rest position and a fully depressed position so as to define, between these two positions, an actuation volume Va that is greater than, or preferably substantially equal to, the stroke volume Vc of the assembly sleeve: $Va \geq Vc$. As a result of this relationship, it is possible to package the dispenser while guaranteeing that it is not under increased pressure, and ideally that it is at atmospheric pressure, as can be seen below when describing the method of assembling the dispenser.

Advantageously, the dispenser further comprises a protective cap that is provided with closure means for closing the dispenser end of the dispenser cannula in sealed manner. The dispenser can thus be assembled with the cap pre-assembled and, providing $Va \approx Vc$, it is guaranteed that the dispenser is approximately at atmospheric pressure, as explained above.

In another advantageous aspect of the invention, the reservoir and the dispenser cannula are made in the form of a single-piece body that is advantageously made of a transparent material. The actuator member may also be made of a transparent material.

The invention also defines an assembly method for assembling the dispenser as defined above with $Va \geq Vc$, the method comprising the following steps:

a) filling the reservoir in part via its assembly opening in the absence of the actuator member;

b) engaging the actuator member in the assembly opening of the reservoir, the deformable membrane being held in its fully depressed position when the assembly sleeve comes into sealed contact with the assembly opening of the reservoir; and c) while the assembly sleeve is in sealed contact with the assembly opening of the reservoir, releasing the deformable membrane, which thus returns into its rest position.

In this way, it is guaranteed that there is no increase in pressure in the dispenser once it is completely assembled.

Advantageously, the assembly method comprises the following successive steps:

b1) deforming the deformable membrane into its fully depressed position;

b2) engaging the actuator member in the assembly opening of the reservoir until the assembly sleeve comes into sealed contact with the assembly opening of the reservoir;

c1) releasing the deformable membrane so that it returns into its rest position; and c2) moving the actuator member in the assembly opening of the reservoir, so as to cause the assembly sleeve to slide in sealed manner in the assembly opening until it reaches its final sealed assembled position.

Thus, suction is created in the dispenser when the membrane is released, then some or all of the suction is compensated for by sliding the assembly sleeve in sealed manner in the assembly opening.

In a variant, the assembly method comprises the following successive steps:

b1) deforming the deformable membrane into its fully depressed position;

b2) engaging the actuator member in the assembly opening of the reservoir until the assembly sleeve comes into sealed contact with the assembly opening of the reservoir; and c12) progressively releasing the deformable membrane so that it returns into its rest position as the assembly sleeve slides in sealed manner in the assembly opening, the rest position and the final sealed assembled position advantageously being reached substantially simultaneously.

In this variant, the pressure in the dispenser is maintained substantially at atmospheric pressure given that the two volumes Va and Vc vary simultaneously and in opposite or compensatory manner. Advantageously, the axial force necessary to deform the deformable membrane from its rest position into its final sealed assembled position is less than the friction forces between the assembly sleeve and the assembly opening during sealed sliding for reaching the final sealed assembled position. It is thus possible to deform the membrane without causing the sleeve to slide in the opening.

Preferably, the dispenser end of the dispenser cannula is closed in sealed manner during the assembly method. The dispenser may thus be put under pressure or suction without causing fluid to be dispensed. With $Va \approx Vc$, the dispenser ends up at atmospheric pressure, even if it is subjected to suction or pressure while being assembled. The user could remove the protective cap without any effect on the fluid.

The present invention is described more fully below with reference to the accompanying drawings, which show an embodiment of the present invention by way of non-limiting example.

Figure 1:
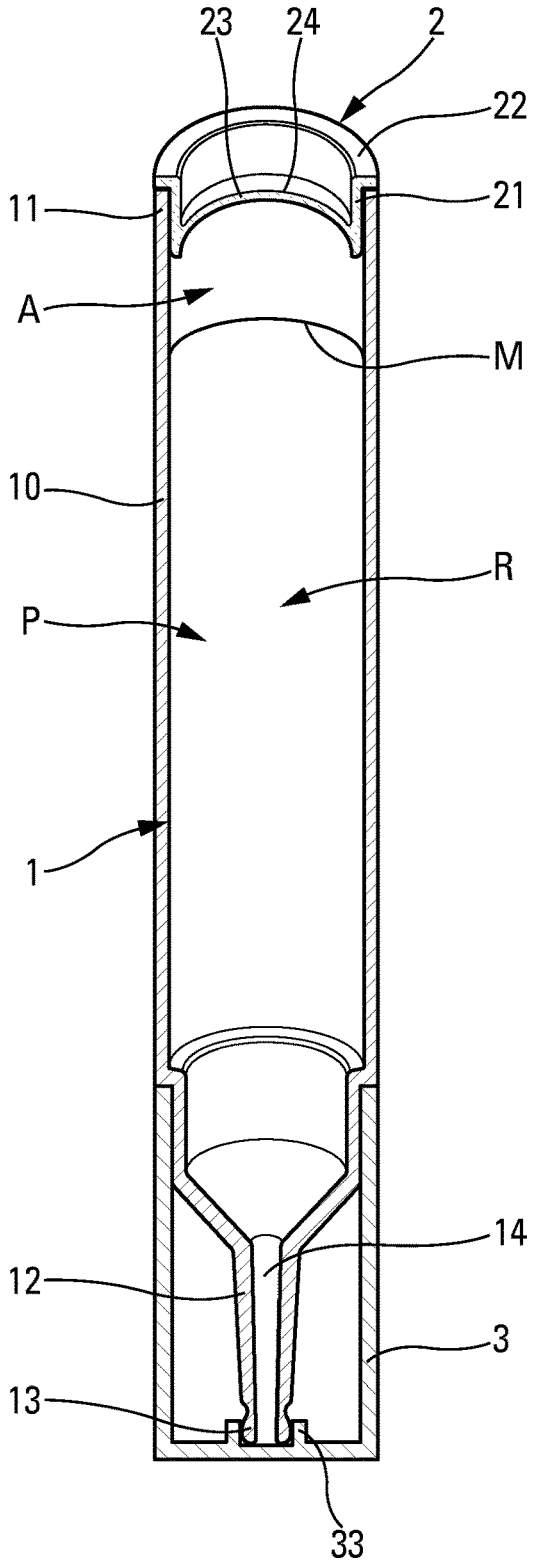
FIG. 1 is a vertically cut-away perspective view through a fluid dispenser of the invention, shown at rest.
Figure 2:
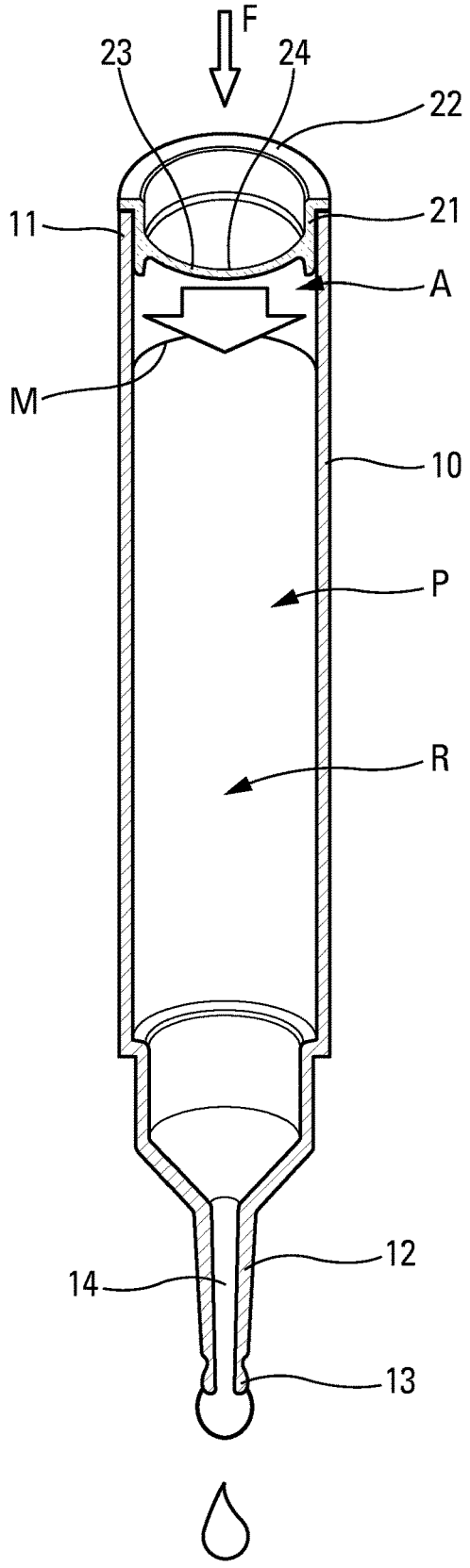
FIG. 2 is a view similar to the view in FIG. 1, shown during dispensing.

Reference is made firstly to FIGS. 1 and 2 in order to describe in detail the structure and the operation of a fluid dispenser of the invention, which is in the form of a dropper dispenser. However, the invention is not limited exclusively to dropper dispensers, and may apply to other types of dispenser.

The dispenser of the invention comprises three component elements, namely a main body 1, an actuator member 2, and a protective cap 3. In some circumstances, the cap 3 may be optional.

The main body 1 may be made of any appropriate material, such as a plastics material that is translucent or transparent. It may also be made of glass. The main body 1 may be made as a single piece, i.e. made as a single-piece part, or it may be made by assembling together a plurality of separate parts. It is also possible to envisage making the main body 1 by using over-molding or bi-injection methods.

The main body 1 includes a cylinder 10 that, in this embodiment, presents a section that is constant, in particular circular. At its top end, the cylinder 10 includes an assembly opening 11 in which the actuator member 2 is engaged, as described below. At its opposite end, the main body 1 forms a dispenser cannula 12 that internally defines an outlet duct 14. The dispenser cannula 12 forms a dispenser end 13 that is configured in such a manner as to be suitable for forming a drop of fluid that separates from the dispenser end 13 by gravity, as can be seen in FIG. 2. The fluid accumulates at the outlet of the dispenser end 13, as can be seen in FIG. 2, until the drop is large enough for its own weight to cause it to separate from the dispenser end 13 and fall in the form of a drop. The particular configuration of the dispenser end 13 means, amongst other things, that the dispenser can be referred to as a dropper dispenser.

Between the cylinder 10 and the dispenser cannula 12, the main body 1 forms a shoulder 15 that is extended by a neck 16 that is connected to the cannula 12 via a frustoconical interconnection section 17. The particular shape of the main body 1 between the cylinder 10 and the cannula 12 is not critical to the present invention, such that other embodiments are possible.

The actuator member 2 may be made as a single piece by injection-molding a relatively flexible plastics material, such as thermoplastic polymer. The actuator member 2 comprises an assembly sleeve 21 of shape that is generally cylindrical, a projecting collar 22 that extends outwards at the top end of the assembly sleeve 21, and a deformable membrane 23 that extends inside the assembly sleeve 21, e.g. in the proximity of its bottom end. The deformable nature of the membrane 23 can be obtained by a wall thickness that is smaller than the wall thickness of the sleeve 21 or of the collar 22. In FIG. 1, the actuator member 2 is in its rest state, and it should be observed that the deformable membrane 23 is upwardly dome-shaped, i.e. convex towards the collar 22. In other words, the deformable membrane 23 is concave towards the inside of the cylinder 10. In its assembled state, the actuator member 2 is engaged inside the assembly opening 11 of the main body 1, with the assembly sleeve 21 engaged inside the opening 11, and the collar 22 bearing against the top annular edge of the assembly opening 11. The deformable membrane 23 is in its rest position, with is convex shape facing outwards.

When assembled on the main body 1, as shown in FIG. 1, the protective cap 3 covers the dispenser cannula 12 and advantageously closes the outlet duct 14 in sealed manner. To do this, the protective cap 3 may define a small dish 33 in which the dispenser end 13 is engaged in sealed manner. By way of example, the dish 33 may be made of a flexible material that is connected to the remainder of the cap 3 by overmolding or by bi-injection. In order to ensure that the cap 3 is held in place on the main body 1, it may for example be force-fitted around the neck 16 in such a manner as to come into abutment bearing against the shoulder 15. It is also possible to provide releasable snap-fastening between the neck 16 and the cap 3.

The dispenser of the invention thus defines a fluid reservoir R that extends from the deformable membrane 23 to the inlet of the dispenser cannula 12. The reservoir R is mainly defined by the cylinder 10: it also extends into the neck 16 and into the frustoconical interconnection section 17. The fluid P stored in the reservoir R thus communicates directly with the dispenser duct 14. In a variant, it is possible to provide a two-way valve at the inlet of the dispenser cannula 12 so as to increase head loss between the reservoir R and the dispenser duct 14. It should also be observed that the reservoir R also contains air A above the meniscus M of the fluid P. In other words, the air A is situated between the deformable membrane 23 and the meniscus M, inside the cylinder 10, when the dispenser cannula 12 points downwards, as shown in FIGS. 1 and 2. The fluid P is thus in direct communication with the dispenser duct 14.

Figure 3:
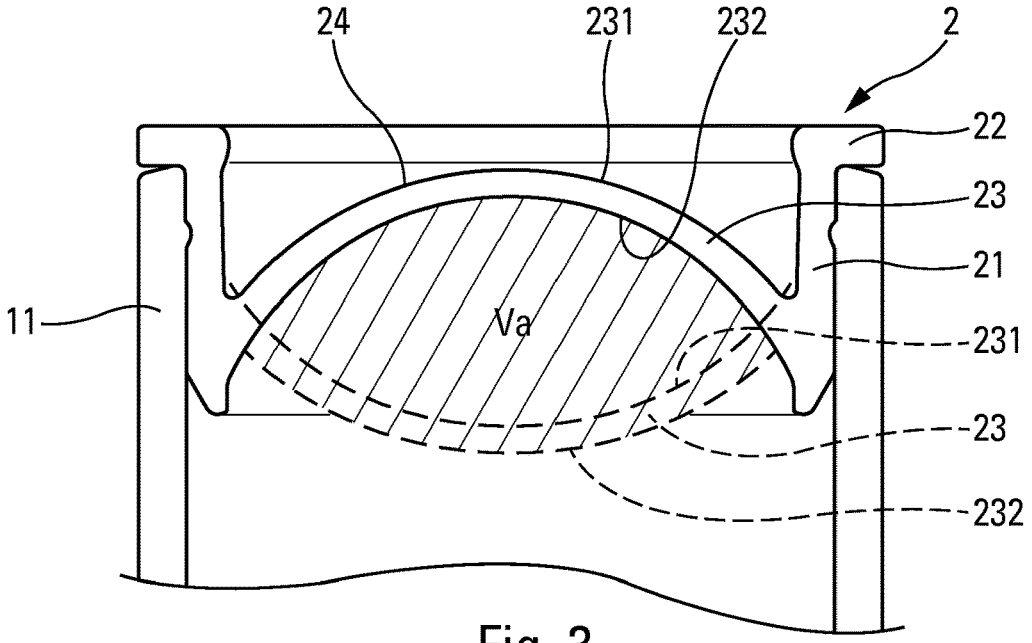
FIG. 3 is a much larger-scale view of the actuator member engaged in the assembly opening of the reservoir.

In the invention, the deformable membrane 23 defines an outside face 231 and an inside face 232, as can be seen in FIG. 3. The outside face 231 forms a pusher 24 on which the user can press by means of a finger or a thumb, so as to move the deformable membrane 23 towards the inside of the cylinder 10. In FIG. 1, the dispenser is provided with its protective cap 3, and pressing on the pusher 24 has no effect other than to compress the air A held captive inside the reservoir R. The fluid P is indeed subjected to pressure, but since its dispenser duct 14 is plugged by the dish 33, no fluid is dispensed. In contrast, when the cap 3 is removed as shown in FIG. 2, pressing on the pusher 24 in the direction of arrow F1, causes the membrane 23 to deform until it reaches a fully depressed position, as shown in FIG. 2, and as shown in FIG. 3 by dashed lines. The air A held captive in the reservoir is thus put under pressure and the resulting force F2 is exerted on the fluid P at its meniscus M. In response, fluid P is driven through the dispenser duct 14 and accumulates at the dispenser end 13 in the form of a drop that increases in size until it separates from the cannula 12 on reaching a critical size. This is shown in FIG. 2.

Given that the air A is compressible, the pressing force F1 is not transmitted directly to the fluid P: on the contrary, it is damped by the air A, so that the delivered force F2 is less than the pressing force F1. In this way, sudden dispensing of fluid is avoided, which prevents a train of successive drops being formed.

FIG. 3 shows the actuator member 2 that is engaged inside the assembly opening 11 of the main body 1. The assembly sleeve 21 is engaged with the inner wall of the assembly opening 11, and the projecting collar 22 comes to bear against the top annular edge of the opening 11. The deformable membrane 23 is drawn with continuous lines in its rest position, and with dashed lines in its fully depressed position. An actuation volume Va is thus defined between the two extreme positions. The volume Va is represented by the hatched zone in FIG. 3. In other words, when the user presses on the pusher 24 so as to depress the deformable wall 23 until it reaches its fully depressed position, a quantity of fluid P that corresponds substantially to the actuation volume Va is dispensed through the dispenser cannula 12. In reality, the quantity of fluid dispensed is a little less than the actuation volume Va, because of the compressibility of the air A held captive in the reservoir R.

Figure 4:
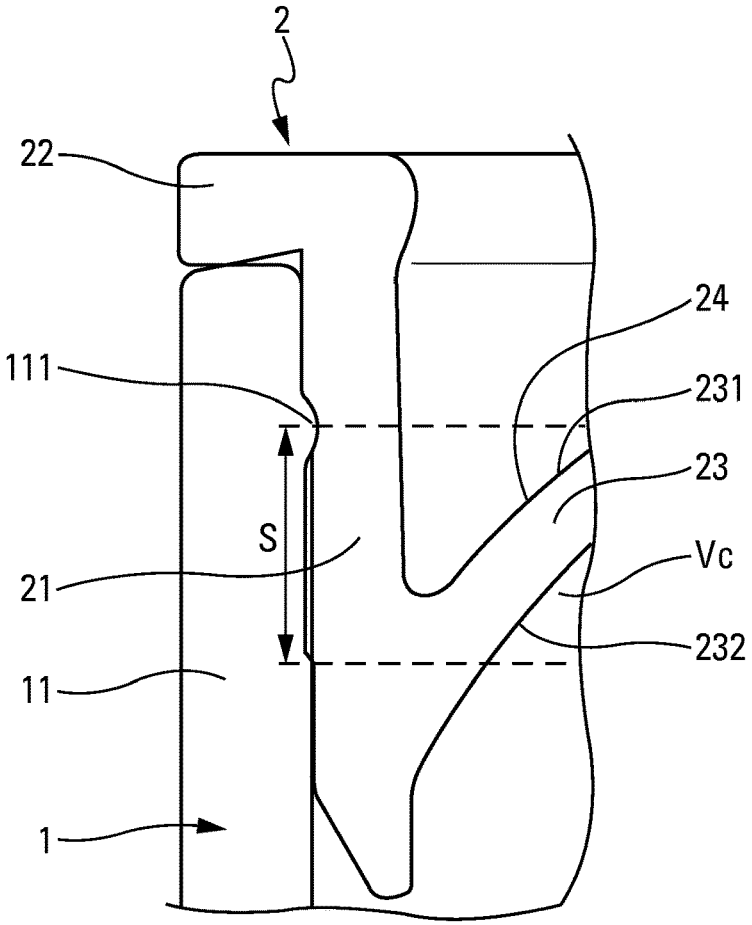
FIG. 4 is an even larger-scale view of a detail D of FIG. 3.

In order to reach its final assembled position, the actuator member 2 is engaged in the assembly opening 1, and then it is depressed so as to travel along one sealed axial stroke S, as shown in FIG. 4. By way of example, the outer wall of the assembly sleeve 21 may come into contact with a sealing rib 111 that is formed inside the assembly opening 11. Once engaged in the opening 11, the sleeve 21 comes into sealed contact with the sealing rib 111, and then, from this moment, the sleeve 21 slides in sealed manner against the sealing rib 111, over an axial height that corresponds to the sealed axial stroke S, so as to arrive finally in its final assembled position in which the collar 22 comes to bear against the top annular edge of the opening 11. It is also possible to provide snap-fastening for the sleeve 21 around or below the rib 111. The sealed axial stroke S defines a stroke volume Vc, that is merely the product of the stroke S multiplied by the inside diameter of the opening 11.

In the invention, the actuation volume Va is greater than the stroke volume Vc. Preferably, the actuation volume Va is greater than the stroke volume Vc by a very small amount, or it is substantially equal to said stroke volume Vc. Below, it can be seen how advantage can be taken of this relationship between the two volumes Va and Vc in order to optimize assembly of the dispenser.

Specifically, it is preferable for the fluid P stored inside the reservoir R to be at atmospheric pressure when the user removes the protective cap 3 for the first time, so as to avoid any fluid being accidentally dispensed. However, given that the actuator member 2 is inserted into the assembly opening 1 by travelling along one sealed axial stroke of volume Vc, the air A situated above the meniscus M, after filling the reservoir with fluid, is normally put under pressure. Putting the air under pressure in this way could possibly cause the membrane 23 to deform and to remain stretched in this way for a relatively long period of storage.

In order to avoid any increase in pressure of the fluid inside the reservoir, or any stretching deformation of the membrane 23, the present invention defines a particular assembly method comprising the following successive steps:

a) filling the reservoir R with fluid P via its assembly opening 11 in the absence of the actuator member 2;

b) engaging the actuator member 2 in the assembly opening 11 of the reservoir R, the deformable membrane 23 being held in its fully depressed position when the assembly sleeve 21 comes into sealed contact with the assembly opening 11 of the reservoir R; and c) while the assembly sleeve 21 is in sealed contact with the assembly opening 11 of the reservoir R, releasing the deformable membrane 23, which thus returns into its rest position.

Step b) above may be sub-divided into two sub-steps:

b1) deforming the deformable membrane 23 into its fully depressed position; and b2) engaging the actuator member 2 in the assembly opening 11 of the reservoir R until the assembly sleeve 21 comes into sealed contact with the assembly opening 11 of the reservoir R.

Figure 5:
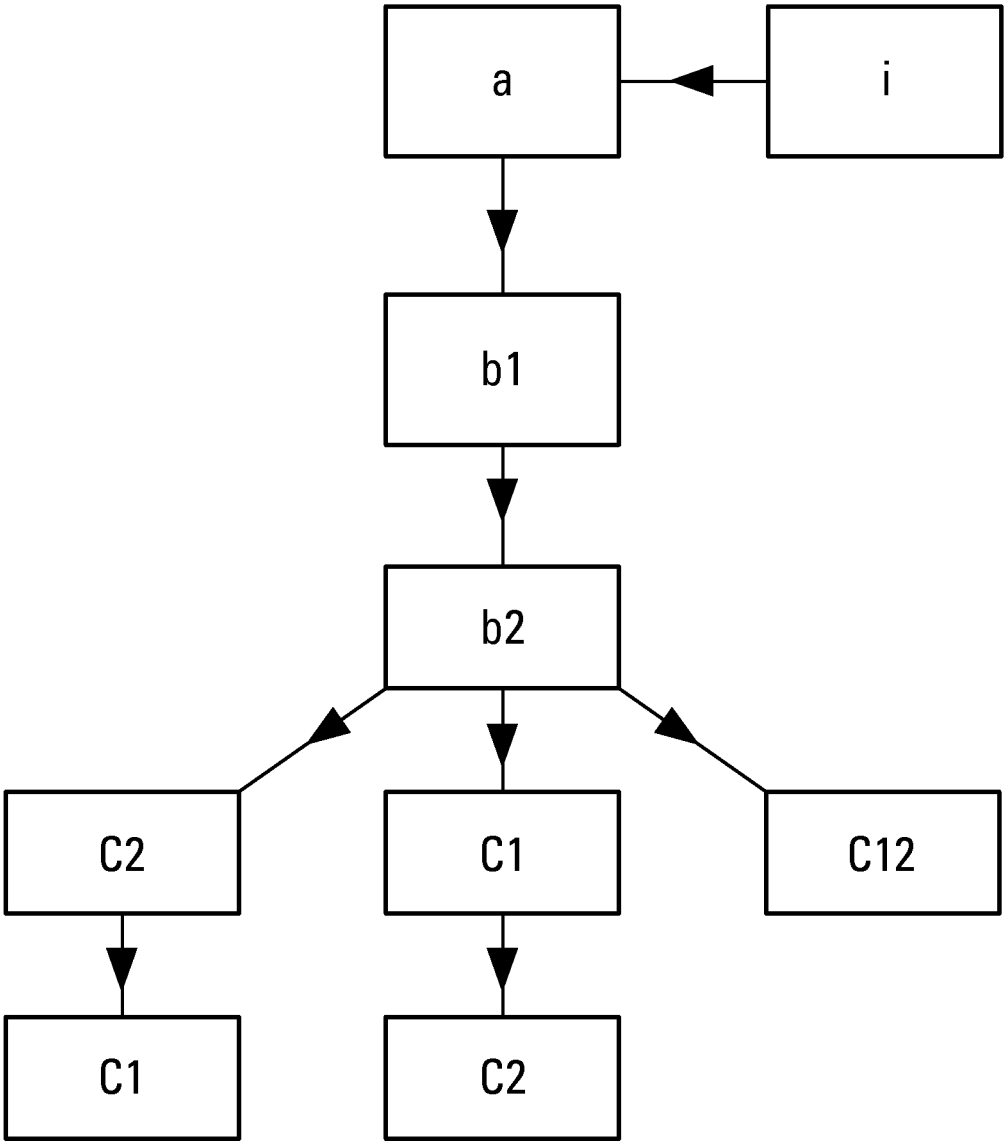
FIG. 5 is a flowchart showing the various steps of assembling the dispenser, with possible variants.

Step c) above may be sub-divided into two sub-steps that may be performed in any order:

c1) releasing the deformable membrane 23 so that it returns into its rest position; and c2) moving the actuator member 2 in the assembly opening 11 of the reservoir R, so as to cause the assembly sleeve 21 to slide in sealed manner in the assembly opening 11 until it reaches its final sealed assembled position. Intervention of the two sub-steps c1 and c2 is shown in FIG. 5.

In a variant, step c) may comprise a single step c12) during which the deformable membrane 23 is released progressively so that it returns into its rest position while the assembly sleeve 21 slides in sealed manner in the assembly opening 11, the rest position and the final sealed assembled position advantageously being reached substantially simultaneously. In this situation, no increased pressure is generated in the reservoir R, since the volumes Va and Vc vary simultaneously and in opposite directions.

It is thus possible to choose between the following sub-steps:

c1, then c2, creating increased pressure momentarily;

c2, then c1, creating suction momentarily; or c12, creating no variation in pressure.

It is also advantageous for the axial force necessary to deform the deformable membrane 23 from its rest position into its final sealed assembled position to be less than the friction forces between the assembly sleeve 21 and the assembly opening 11 during sealed sliding for reaching the final sealed assembled position. Thus, it is possible firstly to press directly on the membrane in order to bring it into its fully depressed position, and then secondly to cause the sleeve 21 to slide in the opening 11

As mentioned above, the reservoir is not filled completely, such that there is air in the reservoir when the actuator member is engaged in the assembly opening of the reservoir, thereby making it possible to compress and to expand the air held captive in the reservoir during steps b) and c).

In all variations, and in particular with sub-steps c1 and c2, it is preferable, or even necessary, for the protective cap 3 to be in place, so as to close the dispenser duct 14. In this way, it is possible to avoid any outflow of fluid or any inflow of outside air. This prior or initial step of putting the cap 3 in place is represented by the block i) in the FIG. 5 flowchart. The cap 3 could be replaced by any other closure means while performing the method of assembly.

The invention provides a very simple dispenser that is instinctive to use and very accurate. Furthermore, the method of assembly guarantees that the dispenser as delivered to the user is at atmospheric pressure.

The invention claimed is:

1. An assembly method for assembling a dispenser, wherein the dispenser comprises:

a reservoir containing fluid and air, the reservoir forming an assembly opening;

a fluid dispenser cannula in communication with the reservoir, the dispenser cannula forming a dispenser end; and an actuator member engaged in the assembly opening, for supplying the dispenser cannula with fluid coming from the reservoir;

wherein the actuator member comprises a deformable membrane that defines an outside face forming a pusher, and an inside face that is in contact with the air of the reservoir, when the dispenser cannula is in contact with the fluid of the reservoir;

wherein the actuator member includes an assembly sleeve that is inserted in sealed manner in the assembly opening of the reservoir;

wherein the assembly sleeve performs one sealed axial stroke in the assembly opening of the reservoir in order to reach its final sealed assembled position, the sealed axial stroke defining a stroke volume Vc; and wherein the deformable membrane is movable between a rest position and a fully depressed position so as to define, between these two positions, an actuation volume Va that is greater than, or preferably substantially equal to, the stroke volume Vc of the assembly sleeve;

the method comprising the following steps:

a) filling the reservoir with fluid via its assembly opening in the absence of the actuator member;

b) engaging the actuator member in the assembly opening of the reservoir, the deformable membrane being held in its fully depressed position when the assembly sleeve comes into sealed contact with the assembly opening of the reservoir; and c) while the assembly sleeve is in sealed contact with the assembly opening of the reservoir, releasing the deformable membrane, which thus returns into its rest position.

2. The assembly method according to claim 1, wherein the dispenser comprises a protective cap that is provided with closure means for closing the dispenser end of the dispenser cannula in sealed manner.

3. The assembly method according to claim 2, wherein the reservoir and the dispenser cannula are made in the form of a single-piece body that is advantageously made of a transparent material.

4. The assembly method according to claim 1, comprising the following successive steps:

b1) deforming the deformable membrane into its fully depressed position;

b2) engaging the actuator member in the assembly opening of the reservoir until the assembly sleeve comes into sealed contact with the assembly opening of the reservoir;

c1) releasing the deformable membrane so that it returns into its rest position;

c2) moving the actuator member in the assembly opening of the reservoir, so as to cause the assembly sleeve to slide in sealed manner in the assembly opening until it reaches its final sealed assembled position.

5. The assembly method according to claim 1, comprising the following successive steps:

b1) deforming the deformable membrane into its fully depressed position;

b2) engaging the actuator member in the assembly opening of the reservoir until the assembly sleeve comes into sealed contact with the assembly opening of the reservoir;

c12) progressively releasing the deformable membrane so that it returns into its rest position as the assembly sleeve slides in sealed manner in the assembly opening, the rest position and the final sealed assembled position advantageously being reached substantially simultaneously.

6. The assembly method according to claim 5, wherein the axial force necessary to deform the deformable membrane from its rest position into its final sealed assembled position is less than the friction forces between the assembly sleeve and the assembly opening during sealed sliding for reaching the final sealed assembled position.

7. The assembly method according to claim 1, wherein the dispenser end of the dispenser cannula is closed in sealed manner.

8. The assembly method according to claim 1, wherein the dispenser is a dropper dispenser.

9. The assembly method according to claim 1, wherein the dispenser end is configured to form a drop of fluid that separates from the dispenser end by gravity.

* * * * *